US006346849B1

(12) United States Patent
Pioppo

(10) Patent No.: US 6,346,849 B1
(45) Date of Patent: Feb. 12, 2002

(54) METHOD AND CIRCUIT FOR PRODUCING THERMALLY STABLE VOLTAGE AND CURRENT REFERENCES WITH A SINGLE BAND-GAP STAGE

(75) Inventor: Sergio Pioppo, Mascalucia (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 09/590,492

(22) Filed: Jun. 9, 2000

(30) Foreign Application Priority Data

Jun. 9, 1999 (IT) ..... VA99A0014

(51) Int. Cl.[7] ..... G05F 1/10; G05F 3/02
(52) U.S. Cl. ..... 327/539; 327/513; 323/313
(58) Field of Search ..... 327/262, 513, 327/539; 323/313, 314

(56) References Cited

U.S. PATENT DOCUMENTS 4,808,908 A * 2/1989 Lewis et al. ..... 323/313
5,258,702 A * 11/1993 Conzelmann et al. ..... 323/313
5,291,122 A * 3/1994 Audy ..... 323/313
5,621,308 A * 4/1997 Kadanka et al. ..... 323/315

* cited by examiner

*Primary Examiner*—Terry D. Cunningham
*Assistant Examiner*—Quan Tra
(74) *Attorney, Agent, or Firm*—Lisa K. Jorgenson; Allen, Dyer, Doppelt, Milbrath & Gilchrist, P.A.

(57) ABSTRACT

A band gap reference stage includes a pair of transistors each having a conduction terminal and a control terminal, the control terminals of the transistors being connected together. A circuit is also included for causing substantially identical currents to pass through each of the pair of transistors. The circuit includes first and second resistors connected in series to a voltage reference. The conduction terminal of one of the pair of transistors is coupled to the voltage reference by the first and second resistors, the conduction terminal of the other of the pair of transistors is coupled to the voltage reference by the second resistor. The ratio of the first resistor to the second resistor defines a reference voltage substantially unchanged by a temperature variation on the control terminals of the pair of transistors.

25 Claims, 2 Drawing Sheets

METHOD AND CIRCUIT FOR PRODUCING THERMALLY STABLE VOLTAGE AND CURRENT REFERENCES WITH A SINGLE BAND-GAP STAGE

FIELD OF THE INVENTION

The invention relates to integrated circuits and, more particularly, to band gap circuits for generating thermally stable voltage references.

BACKGROUND OF THE INVENTION

In many integrated circuits, and particularly in those that control the functioning of power steps and protection stages, it is necessary to establish precise and thermally stable voltage references and/or current references that are not affected by the operating temperature of the integrated circuit. To provide such references, a band gap voltage reference followed by a current reference obtained using another band gap stage may be used. Referring to FIG. 1, a prior art band gap voltage reference stage is shown which produces a stable reference voltage expressed by:

$$Vref = Vbe1 + 2\frac{R2}{R1} * Vt * \ln 10 \tag{1}$$

As the operating temperature increases, the base-emitter voltage Vbe1 decreases and the thermal voltage Vt increases, and the opposite occurs when the temperature decreases. Thus, a suitable ratio between the resistance values R2 and R1 may be selected to obtain a reference voltage that is substantially constant despite temperature variations.

If the currents I1 and I2 are identical, then:

$$I1 = I2 = \frac{Vt}{R1} * \ln 10 \tag{2}$$

Both Vt and R1 have a positive temperature variation when their coefficient is different because:

$$Vt = \frac{K * T}{q} \quad \text{and} \quad R(T) = R * (1 + \alpha * T) \tag{3}$$

Accordingly, the current may either increase or decrease depending upon the operating temperature.

Therefore, in order to obtain a constant current reference, an additional precision stage is needed. The additional stage should generate a current substantially uneffected by temperature. A second band gap circuit may be used as a reference current stage for this purpose, as illustrated in FIG. 2. The thermally stable voltage Vref is used as a reference and is typically obtained through a dedicated stage such as the one shown in FIG. 1.

Equation (2) may be used to determine the reference current Iref where, by using different types of integrated resistors for Ra and Rb, the temperature coefficient of the denominator (R1) is made equal to that of the numerator (Vt). For example, one resistor may be implemented by a P+ diffusion where the other may be implemented by a P− diffusion.

Using the two prior art circuits described above requires two distinct precision stages to obtain both voltage and current references as well as double trimming, which in turn requires a substantial area of silicon in an integrated circuit. Accordingly, there is a need for reliable voltage references and current references that have simplified circuitry and that may be implemented using a single band gap stage.

SUMMARY OF THE INVENTION

It is therefore an object of the invention to provide both a voltage reference and a current reference which are substantially uneffected by operating temperature and that may be implemented using a single band gap stage.

This and other objects, features, and advantages of the present invention are provided by a circuit based on a band gap voltage reference stage including a pair of transistors having respective control nodes connected in common and a circuit for causing identical currents to pass through the transistors. An emitter (or source) of one of the transistors is coupled to ground through a first and a second resistor. An emitter (or source) of the other transistor (Q10) is coupled to ground through the second resistor. By adjusting the ratio between the two resistors, it is possible to establish a reference voltage (Vref) that is substantially constant despite varying temperatures on a base (or gate) common control node of the transistors.

The first resistor and the second resistor comprise two different types of integrated resistors. The first integrated resistor has a higher temperature coefficient than the temperature coefficient of the thermal voltage (Vt), and the second integrated resistor has a smaller temperature coefficient than the temperature coefficient of the thermal voltage (Vt).

An integrated circuit for generating a substantially thermally stable reference voltage and a substantially thermally stable reference current according to the invention is also provided. The integrated circuit includes an active load element providing a voltage, a start-up circuit coupled to a voltage reference for causing a bias current to pass through the active load element, and a control stage for controlling the start-up circuit. The control stage includes a first transistor coupled to a bias voltage and a second transistor coupled to the voltage of the active load element.

The integrated circuit also includes at least one band gap voltage reference stage for controlling the active load element. The at least one band gap voltage reference stage includes a pair of transistors and a current mirror coupled to the voltage of the active load element for causing substantially identical currents to pass through each of the pair of transistors. Additionally, a first output stage provides the substantially thermally stable reference voltage. The first output stage includes a high side transistor coupled to the voltage of the active load element and coupled to a supply voltage, and a low side a transistor coupled to the bias voltage. A second output stage converts the substantially thermally stable reference voltage into the substantially thermally stable reference current.

DETAILED DESCRIPTION OF THE PREFERRED EMBODIMENTS

Figure 1:
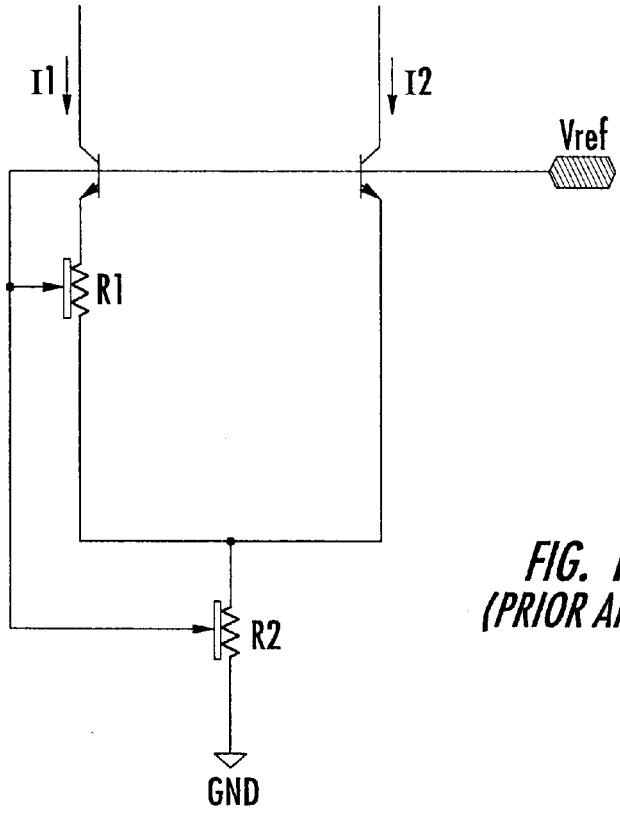
FIG. 1. (PRIOR ART)
FIG. 1 is a schematic diagram of a prior art band gap stage used to generate a voltage reference.
Figure 2:
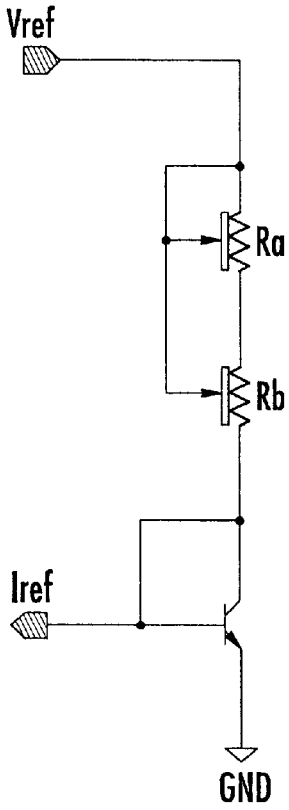
FIG. 2. (PRIOR ART)
FIG. 2 is schematic diagram of a prior art band gap stage used to generate a current reference.
Figure 3:
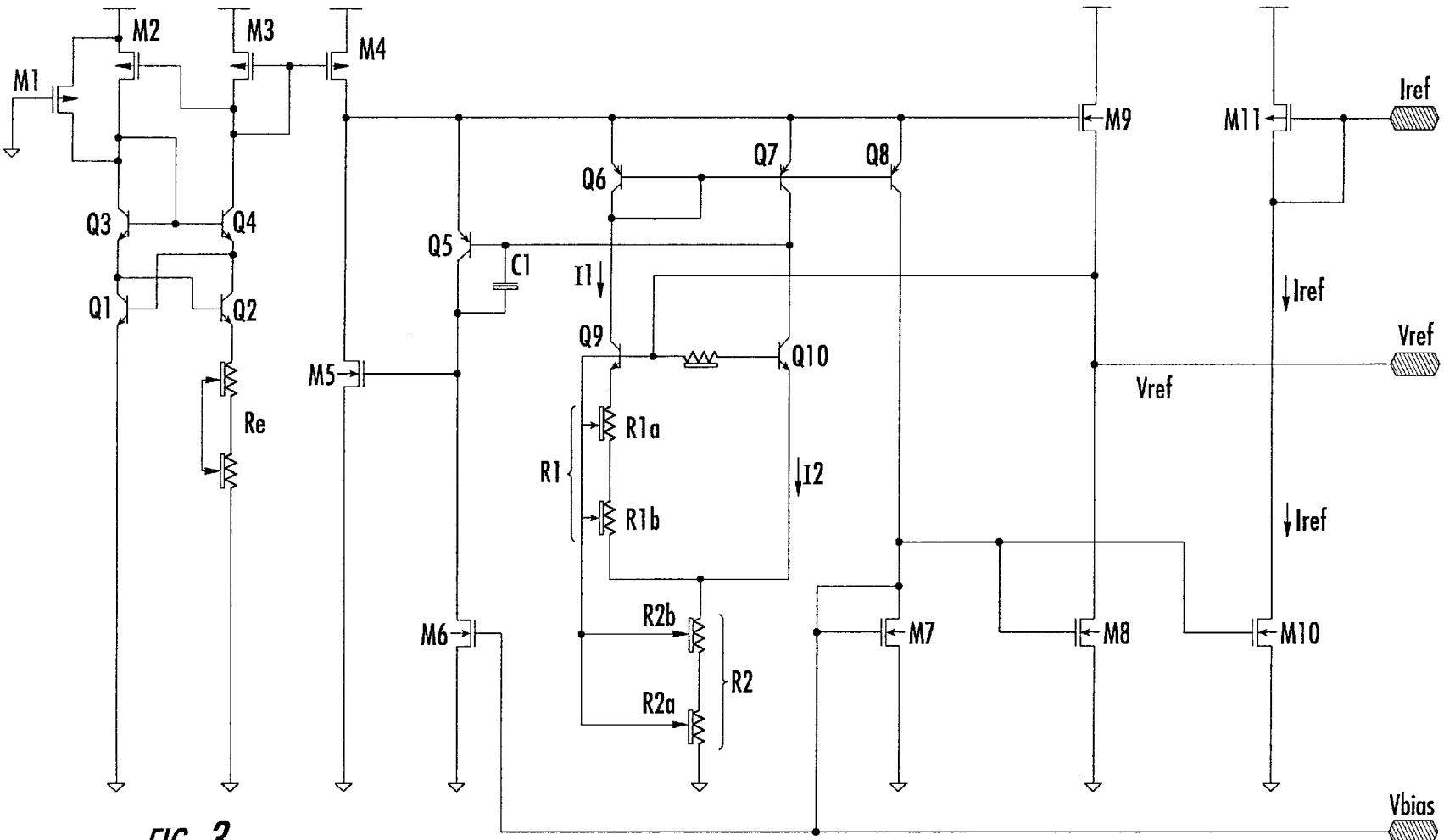
FIG. 3 is a schematic diagram of a circuit according to the present invention for generating thermally stable constant voltage and constant current references.

Turning now to FIG. 3, an integrated circuit according to the present invention for generating a substantially thermally stable reference voltage Vref and a substantially thermally stable reference current Iref is now described. The integrated circuit includes a start-up circuit connected to a supply voltage and including transistors M1–M4, Q1–Q4, and a resistor Re. An active load element M5, such as a transistor, for example, is connected at a first conduction terminal thereof to the start-up circuit and at a second conduction terminal thereof to a voltage reference, e.g., ground. The start-up circuit causes a bias current to pass through the active load element M5.

The integrated circuit further includes a control stage connected to a control terminal of the active load element M5 for the control thereof. The control stage includes a first transistor M6 coupled to a bias voltage Vbias, and a second transistor Q5 coupled to the first conduction terminal of the active load element M5. At least one band gap voltage reference stage may be coupled to a control terminal of the transistor Q5 and includes a pair of transistors Q9, Q10 and a current mirror including transistors Q6, Q7. The current mirror is coupled to the first conduction terminal of the active load element M5 and causes substantially identical currents to pass through each of the pair of transistors Q9, Q10.

A first output stage is connected to the band gap voltage reference stage and provides the substantially thermally stable reference voltage. The first output stage includes a high side transistor M9 coupled to the first conduction terminal of the active load element M5 and coupled at a conduction terminal thereof to the supply voltage. The first output stage further includes a low side transistor M8 driven by the bias voltage Vbias. Further, a second output stage includes transistors M10, M11 and is for converting the substantially thermally stable reference voltage Vref into the substantially thermally stable reference current Iref. A conduction terminal of the transistor M11 connects the second output stage to the supply voltage, and a control terminal of the transistor M10 is also driven by the bias voltage Vbias.

The pair of transistors Q9, Q10 have their respective control terminals connected together, as illustrated in FIG. 3. Additionally, the band gap voltage reference stage may further include first and second resistors R1, R2, as similarly described above with respect to the band gap voltage reference circuits of the prior art, that are connected in series from a conduction terminal of the transistor Q9 to ground. A conduction terminal of the transistor Q10 is coupled to ground only by the second resistor R2.

Yet, in contrast to prior art band gap stages, the resistors R1 and R2 of the present invention are each split into two resistors obtained using different processes. That is, the resistors with the suffix a are obtained by a diffusion process and have a temperature coefficient greater than the temperature coefficient of Vt, and the resistors with the suffix b are obtained by a different diffusion process and have a temperature coefficient smaller than the temperature coefficient of Vt.

The reference currents I1 and I2 are given by the following equation:

$$I = I1 = I2 = \frac{Vt}{R1a + R1b} * \ln 10$$

The respective values of the resistors R1*a* and R1*b* can be made to give a total resistance R1 satisfying the equation:

$$\frac{\delta R1}{\delta T} = \frac{\delta Vt}{\delta T}$$

By doing so, a current reference is obtained that, to a first approximation, does not substantially change as the temperature varies.

Moreover, because the reference voltage is equal to:

$$Vref = Vbe1 + 2 * \frac{R2a + R2b}{R1a + R1b} * Vt * \ln 10$$

if the values of R2*a*, R2*b*, R1*a*, and R2*b* are made such that:

$$\frac{R2a}{R2b} = \frac{R1a}{R1b}$$

then the reference voltage Vref will also remain substantially constant, to a first approximation, as the temperature varies.

Therefore, by making the a and b type resistors as described above during the fabrication process of the integrated circuit, a unique band gap precision stage may be obtained providing both a voltage reference and a current reference. Such a circuit according to the present invention has the following advantages: it uses a unique precision stage to obtain, to a first approximation, thermally stable voltage and current references; the accuracy of both the voltage reference and the current reference may be improved by trimming; and the area of silicon required is reduced, providing a reduction in the cost of the integrated device.

By way of example, the invention has been successfully implemented using BCD3S technology for a low side FET driver for controlling a transmission system in a vehicle. In this application, the reference voltage was 1.25V and the reference current was 10 $\mu$A. The resistors R1*a* and R2*a* were realized by a p− diffusion (i.e., as in the base region of bipolar junction transistors (BJTs) or body region of n-channel metal oxide field-effect transistors (MOSFETs)) whose thermal coefficient of 0.43%° C. was greater than that of the thermal voltage Vt. The resistors R1*b* and R2*b* were realized by a P+ diffusion whose thermal coefficient of 0.164%° C. was smaller than that of the thermal voltage Vt. The value of the resistors was equal to:

R1*a*=3.25 KΩ, R1*b*=2.75 KΩ, R2*a*=14.75 KΩ, R2*b*=12.5 KΩwhere:

$$\frac{R1a}{R1b} = \frac{R2a}{R2b} = 1.18$$

That which is claimed is:

1. A band gap reference stage comprising:

a pair of transistors each having a conduction terminal and a control terminal, the control terminals of said transistors being connected together;

a circuit for causing substantially identical currents to pass through each of said pair of transistors comprising first and second resistors connected in series to a voltage reference, the conduction terminal of one of said pair of transistors being coupled to the voltage reference by said first and second resistors, the conduction terminal of the other of said pair of transistors being coupled to the voltage reference by said second resistor;

the ratio of said first resistor to said second resistor-defining a reference voltage substantially unchanged by a temperature variation on the control terminals of said pair of transistors, said first and second resistors each comprising a first integrated resistor and a second integrated resistor, said first integrated resistors having a temperature coefficient greater than a temperature coefficient of a thermal voltage, and said second integrated resistors being of a different type than said first integrated resistors and having a temperature coefficient smaller than the temperature coefficient of the thermal voltage.

2. The band gap reference stage of claim 1 wherein each of said first integrated resistors is of a type comprising a P– diffusion; and wherein each of said second integrated resistors is of a type comprising a P+ diffusion.

3. The band gap reference stage of claim 2 wherein the P– diffusion comprises a base region of a bipolar junction transistor.

4. The band gap reference stage of claim 2 wherein the P– diffusion comprises a body region of and n-channel metal oxide field-effect transistor.

5. The band gap reference stage of claim 1 wherein each conduction terminal comprises an emitter.

6. The band gap reference stage of claim 1 wherein each conduction terminal comprises a source.

7. The band gap reference stage of claim 1 wherein each control terminal comprises a base.

8. The band gap reference stage of claim 1 wherein each control terminal comprises a gate.

9. A band gap reference stage comprising:

a pair of transistors each having a conduction terminal and a control terminal, the control terminals of said transistors, being connected together;

a circuit for causing substantially identical currents to pass through each of said pair of transistors comprising first and second resistors connected in series to a voltage reference, the conduction terminal of one of said pair of transistors being coupled to the voltage reference by said first and second resistors, the conduction terminal of the other of said pair of transistors being coupled to the voltage reference by said second resistor, said first and second resistors each comprising a first integrated resistor and a second integrated resistor, said first integrated resistors having a temperature coefficient greater than a temperature coefficient of a thermal voltage, and said second integrated resistors being of a different type than said first integrated resistors and having a temperature coefficient smaller than the temperature coefficient of the thermal voltage;

the ratio of said first resistor to said second resistor defining a reference voltage substantially unchanged by a temperature variation on the control terminals of said pair of transistors.

10. The band gap reference stage of claim 9 wherein each of said first integrated resistors is of a type comprising a P– diffusion; and wherein each of said second integrated resistors is of a type comprising a P+ diffusion.

11. The band gap reference stage of claim 10 wherein the P– diffusion comprises a base region of a bipolar junction transistor.

12. The band gap reference stage of claim 10 wherein the P– diffusion comprises a body region of an n-channel metal oxide field-effect transistor.

13. The band gap reference stage of claim 9 wherein each conduction terminal comprises an emitter.

14. The band gap reference stage of claim 9 wherein each conduction terminal comprises a source.

15. The band gap reference stage of claim 9 wherein each control terminal comprises a base.

16. The band gap reference stage of claim 9 wherein each control terminal comprises a gate.

17. An integrated circuit for generating a substantially thermally stable reference voltage and a substantially thermally stable reference current comprising:

an active load element;

a start-up circuit coupled to a supply voltage and to a conduction terminal of said active load element for causing a bias current to pass through said active load element;

a control stage for controlling said active load element comprising a first transistor coupled to a bias voltage and a second transistor coupled to the conduction terminal of said active load element;

at least one band gap voltage reference stage coupled to said control stage and comprising a pair of transistors, and a current mirror coupled to the conduction terminal of said active load element for causing substantially identical currents to pass through each of said pair of transistors;

a first output stage for providing the substantially thermally stable reference voltage comprising a high side transistor coupled to the conduction terminal of said active load element and coupled to the supply voltage, and a low side transistor coupled to the bias voltage; and a second output stage for converting the substantially thermally stable reference voltage into the substantially thermally stable reference current.

18. The integrated circuit of claim 17 wherein said pair of transistors each have a conduction terminal and a control terminal, the control terminals of said pair of transistors being connected together; and wherein said at least one band gap voltage reference stage further comprises first and second resistors connected in series to the voltage reference, the conduction terminal of one of said pair of transistors being coupled to the voltage reference by said first and second resistors, the conduction terminal of the other of said pair of transistors being coupled to the voltage reference by said second resistor.

19. The integrated circuit of claim 18 wherein said first and second resistors each comprise a first integrated resistor and a second integrated resistor, said first integrated resistors having a temperature coefficient greater than a temperature coefficient of a thermal voltage, and said second integrated resistors being of a different type than said first integrated resistors and having a temperature coefficient smaller than the temperature coefficient of the thermal voltage.

20. The integrated circuit of claim 19 wherein each of said first integrated resistors are of a type comprising P– diffusion; and wherein each of said second integrated resistors are of a type comprising P+ diffusion.

21. The integrated circuit of claim 20 wherein the P– diffusion comprises a base region of a bipolar junction transistor.

22. The integrated circuit of claim 20 wherein the P– diffusion comprises a body region of an n-channel metal oxide field-effect transistor.

23. A method for making a band gap reference stage comprising:

providing a pair of transistors;

forming first and second resistors for causing substantially identical currents to pass through each of the pair of transistors, each of the first and second resistors comprising a first integrated resistor having a temperature coefficient greater than a temperature coefficient of a thermal voltage and a second integrated resistor of a different type than the first integrated resistor and having a temperature coefficient smaller than the temperature coefficient of the thermal voltage, the ratio of the first resistor to the second resistor defining a substantially thermally stable reference voltage;

coupling one of the pair of transistors to a voltage reference through the first and second resistors connected in series; and coupling the other of the pair of transistors to the voltage reference through said second resistor.

24. The method of claim 23 wherein each first integrated resistor is formed in a P– diffusion region.

25. The method of claim 23 wherein each second integrated resistor is formed in a P+ diffusion region.

* * * * *